US009643749B2

(12) United States Patent
Wagner

(10) Patent No.: US 9,643,749 B2
(45) Date of Patent: May 9, 2017

(54) CARTON WITH HANDLE FEATURES

(71) Applicant: Graphic Packaging International, Inc., Atlanta, GA (US)

(72) Inventor: Todd Wagner, Medina, OH (US)

(73) Assignee: Graphic Packaging International, Inc., Atlanta, GA (US)

( * ) Notice: Subject to any disclaimer, the term of this patent is extended or adjusted under 35 U.S.C. 154(b) by 688 days.

(21) Appl. No.: 13/998,532

(22) Filed: Nov. 7, 2013

(65) Prior Publication Data

US 2014/0123604 A1 May 8, 2014

Related U.S. Application Data

(60) Provisional application No. 61/796,363, filed on Nov. 7, 2012.

(51) Int. Cl.
*B65D 5/468* (2006.01)
*B65D 77/06* (2006.01)
*B65D 5/40* (2006.01)

(52) U.S. Cl.
CPC ..... *B65D 5/4608* (2013.01); *B65D 77/062* (2013.01)

(58) Field of Classification Search
None
See application file for complete search history.

(56) References Cited

U.S. PATENT DOCUMENTS 1,585,505 A 5/1926 McIndoe
1,909,649 A 5/1933 Bayless
2,000,210 A 5/1935 Bayless
2,047,804 A 7/1936 Shapiro
2,077,173 A 4/1937 Holy
2,123,147 A 7/1938 Snyder
2,517,552 A 8/1950 Field
2,644,633 A 7/1953 Stopper
2,732,122 A 1/1956 Bolding
2,761,611 A 9/1956 Benschoter
2,808,193 A 10/1957 Michalka
2,826,350 A 3/1958 Marx
2,917,222 A 12/1959 Frankenstein
2,950,039 A 8/1960 Wilson
2,954,152 A 9/1960 Buttery et al.
3,101,167 A 8/1963 Styler
3,115,292 A 12/1963 Repking
3,174,675 A 3/1965 Rosenburg, Jr.
3,203,613 A * 8/1965 Stowe ..... B65D 5/4608 229/117.17
3,274,047 A 9/1966 Sloan
3,467,298 A 9/1969 Wysocki
(Continued)

FOREIGN PATENT DOCUMENTS

EP 0 881 153 12/1998

*Primary Examiner* — Gary Elkins
(74) *Attorney, Agent, or Firm* — Womble Carlyle Sandridge & Rice, LLP

(57) ABSTRACT

A carton for containing at least one article is described herein. The carton includes a plurality of side panels that extend at least partially around an interior of the carton, a handle for grasping and carrying the carton formed in at least two side panels of the plurality of side panels, and a protective feature for providing access to grasp the handle. The protective feature includes at least one protective panel arranged in the interior of the carton relative to the handle and the at least two side panels.

47 Claims, 12 Drawing Sheets

(56) References Cited

U.S. PATENT DOCUMENTS

| | | | | | |
|---|---|---|---|---|---|
| 3,549,081 | A | | 12/1970 | Nelson | |
| 3,738,564 | A | | 6/1973 | Persson | |
| 3,765,574 | A | * | 10/1973 | Urquiza | B65D 21/0209 206/504 |
| 3,788,538 | A | * | 1/1974 | Kuenzi | B65D 5/4608 229/117.17 |
| 3,873,017 | A | | 3/1975 | Blatt | |
| 3,952,940 | A | * | 4/1976 | Malcolm | B65D 5/703 229/117.16 |
| 4,199,098 | A | | 4/1980 | Lopez | |
| D263,800 | S | | 4/1982 | Angleman et al. | |
| 4,621,766 | A | * | 11/1986 | McClure | B65D 5/28 229/117.17 |
| 4,736,885 | A | | 4/1988 | Negus, Sr. | |
| 4,974,773 | A | * | 12/1990 | Alexander | B65D 5/0035 206/427 |
| D324,823 | S | | 3/1992 | Scarpa et al. | |
| 5,531,375 | A | | 7/1996 | Palm | |
| 5,566,878 | A | * | 10/1996 | Peiffer | B65D 5/4237 229/117.16 |
| D402,201 | S | | 12/1998 | Miller | |
| 5,887,781 | A | | 3/1999 | Marx et al. | |
| D411,079 | S | | 6/1999 | Graham | |
| D418,750 | S | | 1/2000 | Blin | |
| D442,084 | S | | 5/2001 | Hoffman et al. | |
| D495,598 | S | | 9/2004 | Smith | |
| D506,670 | S | | 6/2005 | Borkoski | |
| 6,926,192 | B1 | * | 8/2005 | Dowd | B65D 5/3621 229/117 |
| D567,076 | S | | 4/2008 | Ballard | |
| D616,300 | S | | 5/2010 | Shaikh | |
| D616,301 | S | | 5/2010 | Stephens | |
| D617,183 | S | | 6/2010 | Stephens | |
| D620,792 | S | | 8/2010 | Shaikh | |
| D628,884 | S | | 12/2010 | Smith | |
| 7,883,000 | B2 | * | 2/2011 | Sheffield | B65D 5/4608 229/117.16 |
| D640,133 | S | | 6/2011 | Jones et al. | |
| D668,951 | S | | 10/2012 | Voelker | |
| D672,645 | S | | 12/2012 | Giannini et al. | |
| 8,474,685 | B2 | | 7/2013 | Shaboo | |
| 8,596,518 | B2 | * | 12/2013 | Babcock | B65D 5/443 229/117.16 |
| D698,242 | S | | 1/2014 | Hartman et al. | |
| 2005/0072796 | A1 | * | 4/2005 | Penfold | B65D 5/029 222/105 |
| 2007/0039846 | A1 | | 2/2007 | Spivey | |
| 2008/0128478 | A1 | | 6/2008 | Quadrelli | |
| 2014/0353364 | A1 | * | 12/2014 | Coogan | B65D 77/065 229/117.3 |

* cited by examiner

CARTON WITH HANDLE FEATURES

CROSS-REFERENCE TO RELATED APPLICATIONS

This application claims the benefit of U.S. Provisional Patent Application No. 61/796,363 filed Nov. 7, 2012.

INCORPORATION BY REFERENCE

The disclosure of U.S. Provisional Patent Application No. 61/796,363, which was filed on Nov. 7, 2012, is hereby incorporated by reference for all purposes as if presented herein in their entirety.

BACKGROUND OF THE DISCLOSURE

The present disclosure generally relates to cartons for holding an article such as an article for holding and dispensing flowable material such as beverages. More specifically, the present disclosure relates to cartons having handles with protective features and other features.

SUMMARY OF THE DISCLOSURE

In general, one aspect of the disclosure is directed to a carton for containing at least one article. The carton includes a plurality of side panels that extend at least partially around an interior of the carton, a handle for grasping and carrying the carton formed in at least two side panels of the plurality of side panels, and a protective feature for providing access to grasp the handle. The protective feature includes at least one protective panel arranged in the interior of the carton relative to the handle and the at least two side panels.

In another aspect, the present disclosure is generally directed to a blank for forming a carton. The blank includes a plurality of side panels for forming an interior of the carton formed from the blank, handle features in at least two side panels of the plurality of side panels for forming a handle for grasping and carrying the carton formed from the blank, and a protective feature for providing access to grasp the handle, the protective feature comprising at least one protective panel configured to be arranged in the interior relative to the handle and the at least two side panels in the carton formed from the blank.

In another aspect, the present disclosure is generally directed to a method of forming a carton. The method includes obtaining a blank comprising a plurality of side panels, handle features in at least two side panels of the plurality of side panels, and a protective feature for providing access to grasp the handle, the protective feature comprising at least one protective panel. The method further includes folding the plurality of side panels to at least partially form an interior of the carton, and positioning the at least one protective panel in the interior relative to the handle and the at least two side panels.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Figure 1:
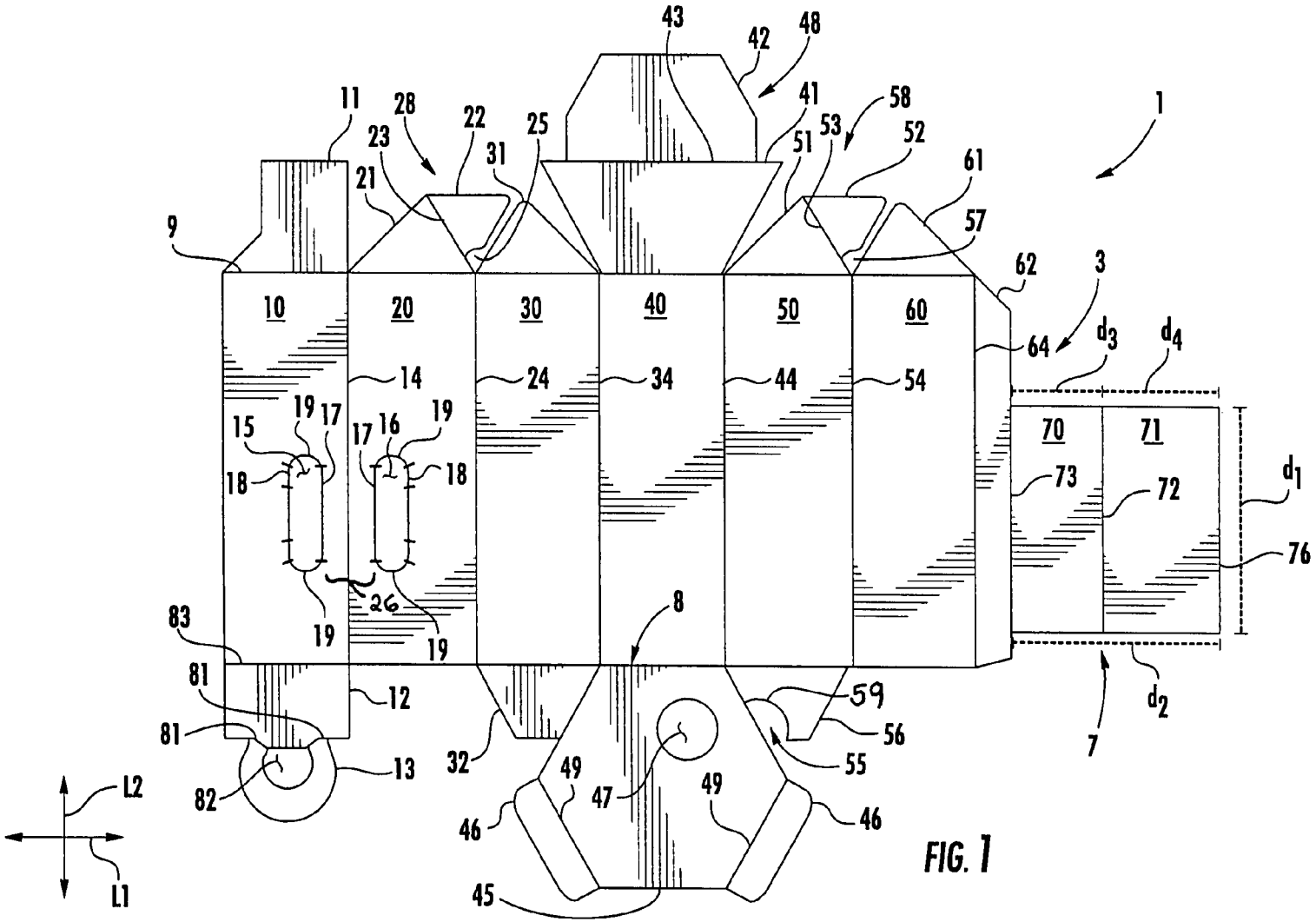
FIG. 1 is a plan view of a blank for forming a carton, according to a first embodiment.
Figure 10:
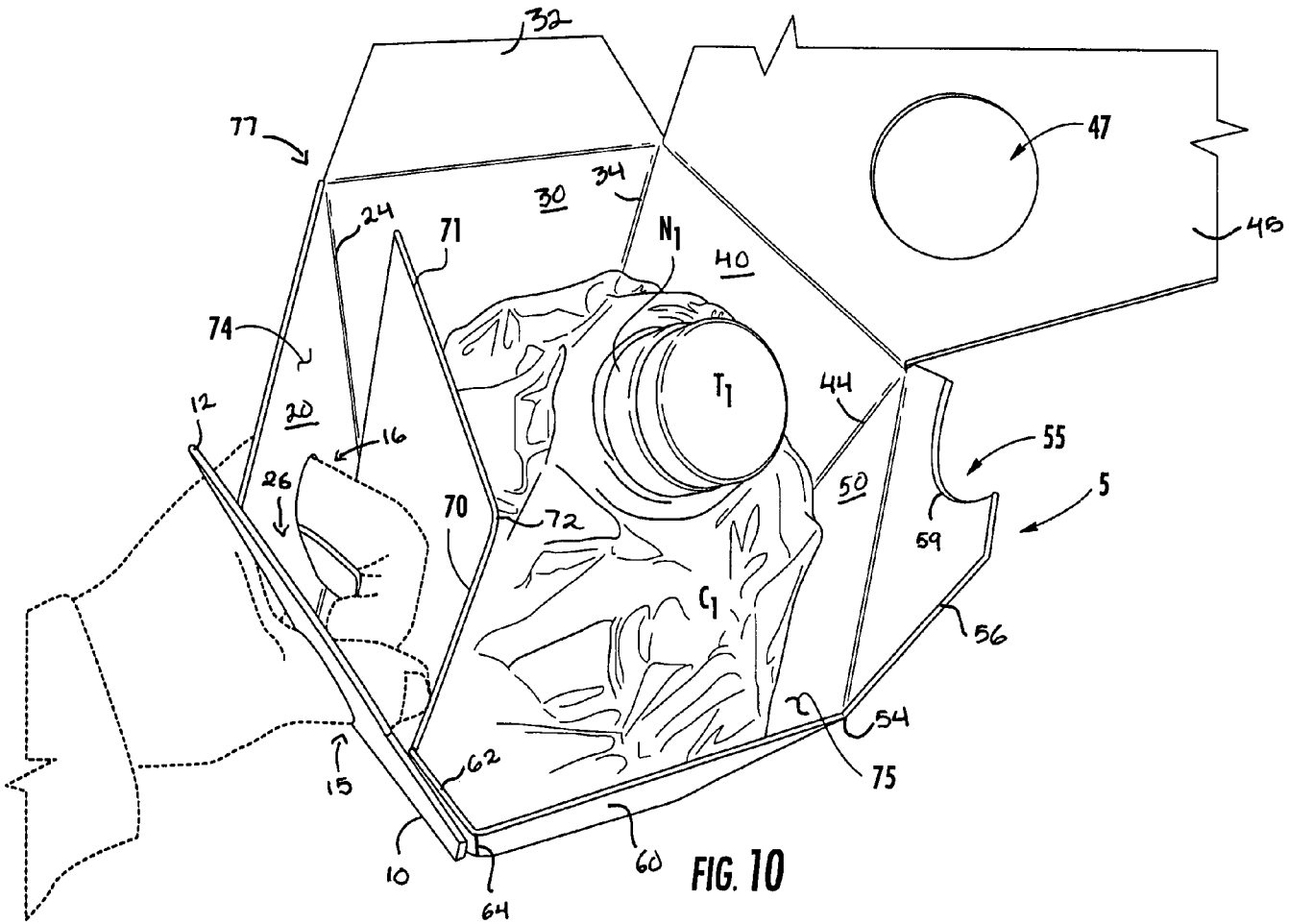
FIG. 10 is a top view similar to FIG. 9, but with an article received in the partially formed carton.

FIG. 1 is a plan view of the exterior side 1 of a blank, generally indicated at 3, used to form a carton 5 (FIG. 2) according to one exemplary embodiment of the disclosure. In one embodiment, the carton 5 contains an article such as a container $C_1$ (FIG. 10). In the illustrated embodiment, the container $C_1$ is a beverage bag with at least one spout or top $T_1$, but the container could be other beverage containers (e.g., cans, plastic bottles, etc.) without departing from the disclosure. In the illustrated embodiment, the carton 5 is sized to house a single container $C_1$ in a single layer, but it is understood that the carton 5 may be sized and shaped to hold containers of a different or same quantity in more than one layer and/or in different arrangements. As discussed below, the carton 5 has a handle 7 and features in the interior of the carton to protect a user's hand from contact with the container $C_1$ when grasping the handle 7.

As shown in FIG. 1, the blank 3 has a longitudinal axis L1 and a lateral axis L2. The blank 3 includes a side panel 40 foldably connected to a bottom panel 48 at a lateral fold line 9. The side panel 40 is also foldably connected to a top panel 45 at a lateral fold line 8. The bottom panel 48 may be a compound panel with a first panel portion 41 and a second panel portion 42 foldably connected to one another at fold line 43. The compound bottom panel 48 may allow auto-bottom forming features for enabling quick and relatively easy assembly of a full carton from a partially constructed collapsed carton.

The first top panel 45 includes an opening 47 configured to receive a spout or top of a container $C_1$ and allow a spout or top $T_1$ to reside at least partially on the exterior of a carton 5 formed from the blank 3 while the remaining portion of the container may be housed in an interior cavity of the assembled carton. The top panel 45 further includes at least two top flaps 46 foldably connected to the top panel 45 at oblique fold lines 49. In the illustrated embodiment, the top panel 45 is generally hexagonal in shape, with the top flaps 46 joined to the top panel 45 at the fold lines 49 corresponding to the sides of the hexagonal shape. The top panel 45 could be otherwise shaped, arranged, and/or configured without departing from the disclosure.

The blank 3 further includes side panel 30 foldably connected to the side panel 40 at longitudinal fold line 34, side panel 20 foldably connected to the side panel 30 at longitudinal fold line 24, and side panel 10 foldably connected to the side panel 20 at longitudinal fold line 14.

The side panel 10 includes a bottom flap 11 foldably connected thereto at lateral fold line 9, and a top flap 12 foldably connected thereto at lateral fold line 83. The bottom flap 11 may be configured to be adhered to, and in generally face-to-face contact with, the second panel portion 42 of the compound bottom panel 48. The adhesive attachment of the bottom flap 11 and second panel portion 42 may allow pivoting of the compound bottom panel 48 at fold line 43 without impinging the easy auto-bottom assembly features noted above. The top flap 12 may include a collar 13 removably attached thereto at cuts 81 that form a tear line. The collar 13 may define a semicircular or partially annular region 82 shaped and arranged to engage a neck portion $N_1$ of a spout.

The side panel 20 includes a bottom end flap that is a compound bottom panel 28 foldably connected thereto at lateral fold line 9. The compound bottom panel 28 includes a first panel portion 21 and a second panel portion 22 foldably attached together at oblique fold line 23. The second panel portion 22 is configured to be adhered to bottom flap 31 which is foldably connected to side panel 30 at lateral fold line 9. The blank 3 includes a notch 25 configured to allow pivoting of the first panel portion 21 relative to the second panel portion 22 during the auto-bottom assembly technique noted above. The side panel 30 further includes top flap 32 foldably connected thereto at lateral fold line 8.

The blank 3 further includes side panel 50 foldably connected to the side panel 40 at longitudinal fold line 44, side panel 60 foldably connected to the side panel 50 at longitudinal fold line 54, and attachment flap 62 foldably connected to the side panel 60 at longitudinal fold line 64.

The blank 3 has a plurality of bottom end flaps 11, 28, 48, 31, 58, 61 foldably connected to a respective side panel 10, 20, 30, 40, 50, 60 at fold line 9 that are for forming the bottom panel that closes the bottom end of the carton 5. The blank 3 has a plurality of top end flaps 12, 32, 45, 56 foldably connected to a respective side panel 10, 30, 40, 50 at fold line 8 that are for forming the top panel that closes the top end of the carton 5. The blank 3 could have other flap/panel arrangements that close the top and/or bottom ends of the carton 5 without departing from the disclosure.

The side panel 50 includes a bottom end flap that is a compound bottom panel 58 foldably connected thereto at lateral fold line 9. The compound bottom panel 58 includes a first panel portion 51 and a second panel portion 52 foldably attached together at oblique fold line 53. The second panel portion 52 is configured to be adhered to bottom flap 61 which is foldably connected to side panel 60 at lateral fold line 9. The blank 3 includes a notch 57 configured to allow pivoting of the first panel portion 51 relative to the second panel portion 52 during the auto-bottom assembly technique noted above. The side panel 50 further includes top flap 56 foldably connected thereto at lateral fold line 8. The top flap 56 has a cutout 55 defined by a curved edge 59.

The blank 3 further includes protective feature 7. The feature 7 includes a first protective panel 70 and a second protective panel 71. The first protective panel 70 is foldably connected to attachment flap 64 at longitudinal fold line 73. The second protective panel 71 is foldably connected to the first protective panel 70 at fold line 72. In one embodiment, the feature 7 may have a longitudinal dimension $d_1$ based on a relative size and placement of handle openings 15, 16. The feature 7 may have a lateral dimension $d_2$ based on an interior dimension of an assembled carton formed from the blank 3. For example, dimension $d_3$ may be determined based on a distance between fold line 73 and fold line 24 in an assembled carton. Each panel 70, 71 may include lateral dimensions $d_3$, and $d_4$, respectively. According to at least one embodiment, the dimension $d_4$ is greater than the dimension $d_3$. According to another embodiment, the dimension $d_3$ is greater than the dimension $d_4$. According to yet another embodiment, the dimensions $d_3$ and $d_4$ are relatively or substantially equal.

The feature 7 is arranged to be positioned relative to handle features comprising handle openings 15, 16 during assembly of a carton from the blank 3. The handle openings 15, 16 may be formed in any panel illustrated on blank 3, including panels 10, 20 as shown. The handle openings 15, 16 may be defined by a longitudinal fold line 17, a longitudinal cut 18, and at least two arcuate cuts 19. The handle features also comprise a handle portion 26 between the handle openings 15, 16. The handle portion 26 includes a portion of the at least two side panels 10, 20 as shown.

Figure 2:
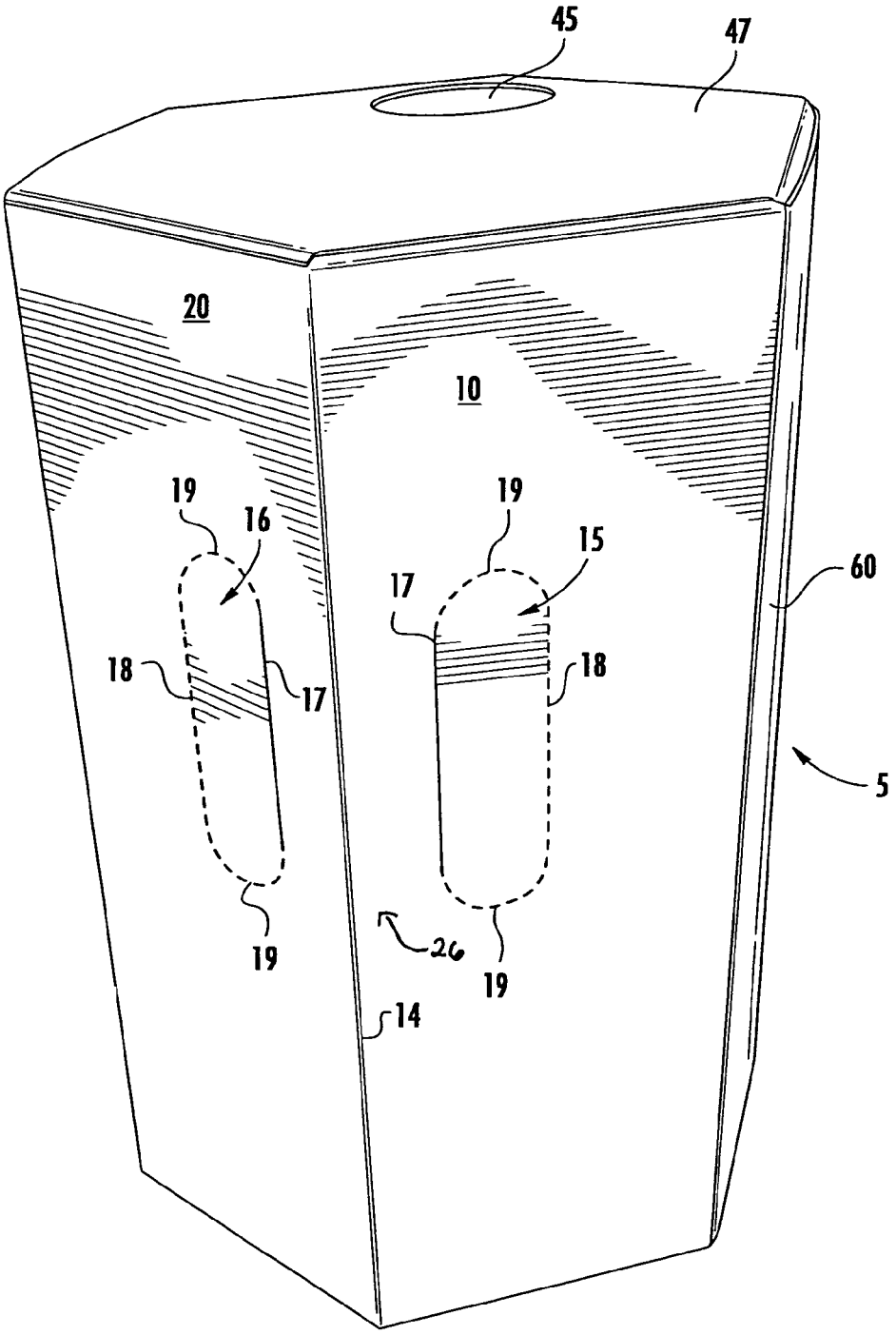
FIG. 2 is a perspective view of a carton formed from the blank of FIG. 1.

Turning to FIG. 2, a perspective view of a carton 5 formed from the blank 3 is illustrated. As shown, the generally hexagonal shape of the top panel 45 allows for positioning of the side panels 10, 20, 30, 40, 50, and 60 about its perimeter. Furthermore, the handle openings 15, 16 are positioned for easy access across longitudinal fold line 14.

Figure 3:
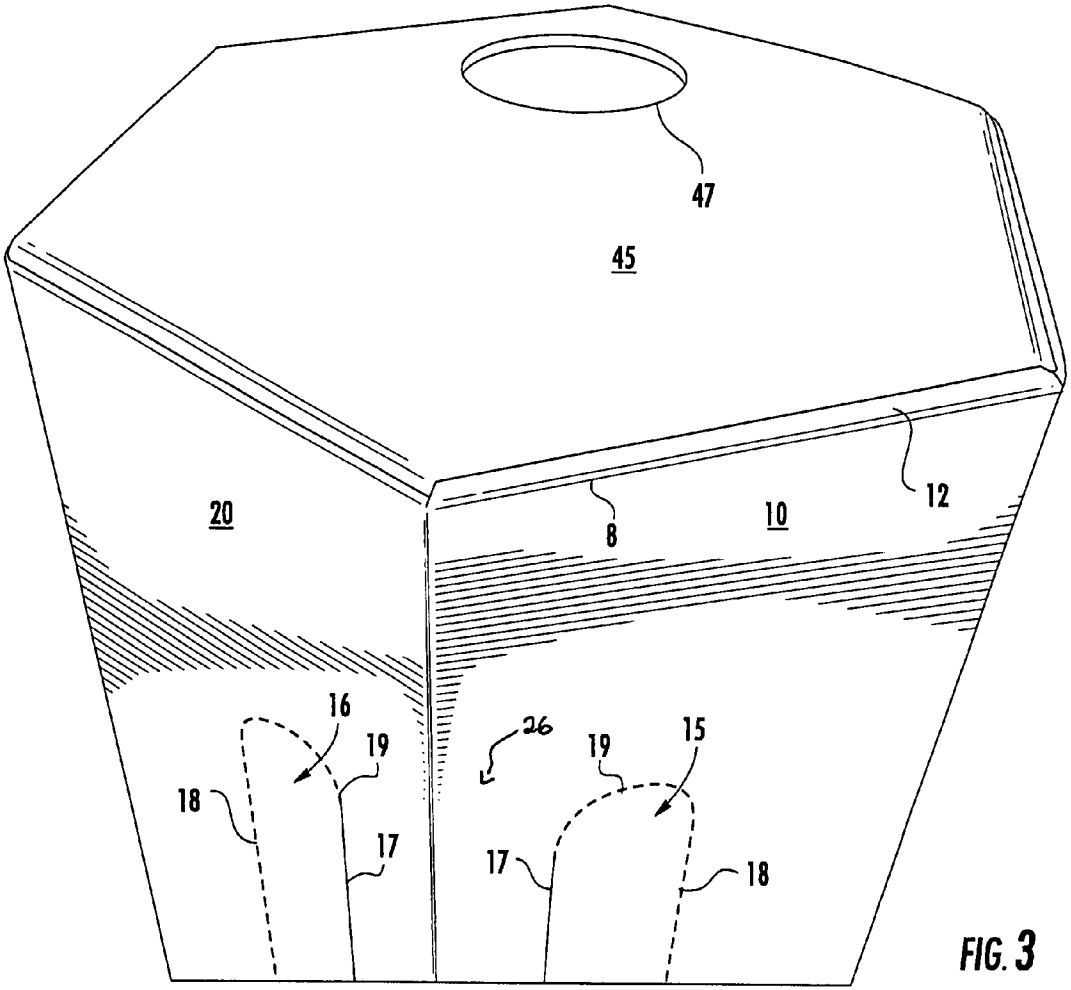
FIG. 3 is an enlarged portion of the perspective view of the carton of FIG. 2.

FIG. 3 is an enlarged perspective view of the carton 5. As shown, lateral fold line 8 is generally parallel to a plane defined by top panel 45, and is arranged about a perimeter of the generally hexagonal shape of the top panel 45.

Figure 4:
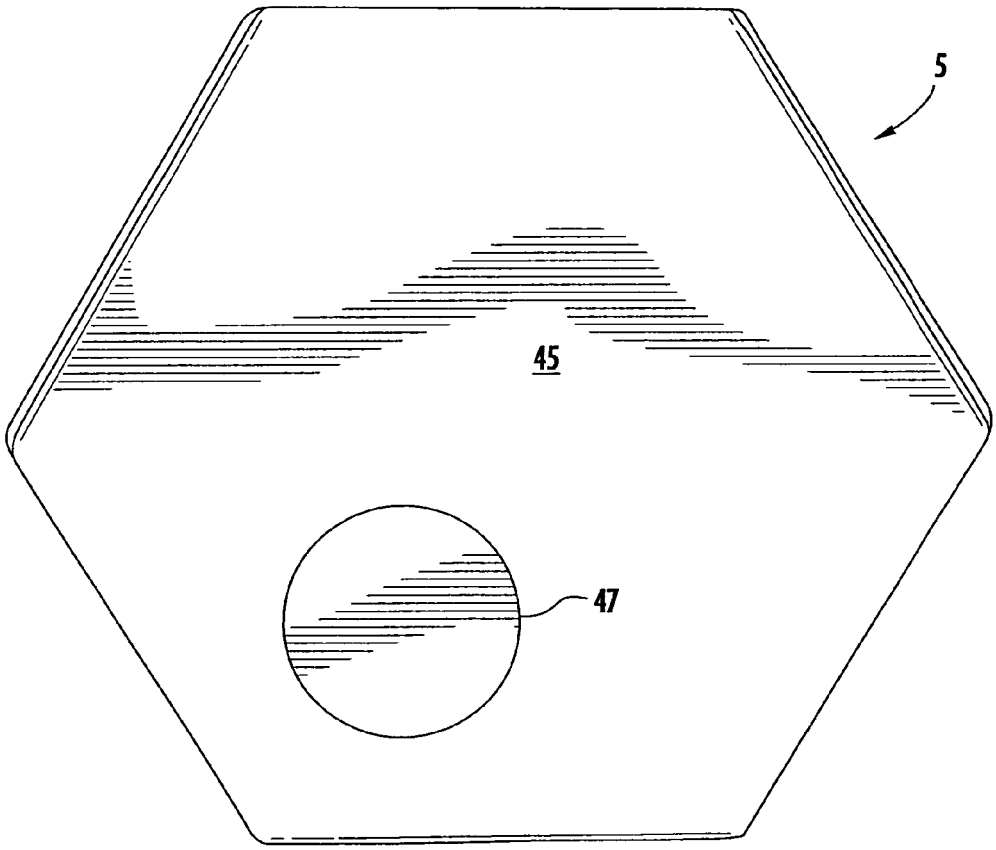
FIG. 4 is a top view of the carton of FIG. 2.

FIG. 4 is a top view of the carton 5. As illustrated, opening 47 allows access to an interior of the carton 5.

Figure 5:
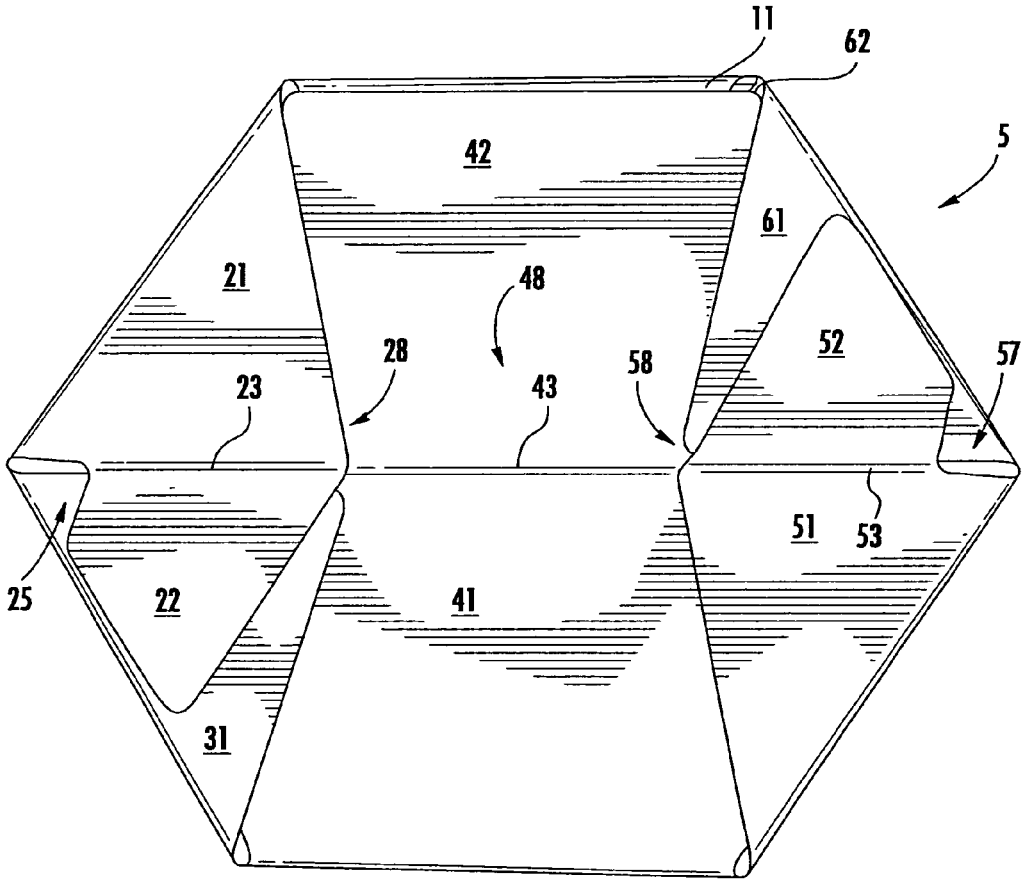
FIG. 5 is a bottom view of the carton of FIG. 2.

FIG. 5 is a bottom view of the carton 5. As illustrated, compound bottom panels 28, 48, and 58 are arranged to pivot about fold lines 23, 43, and 53, respectively. Generally, fold lines 23, 43, and 53 are substantially parallel or almost parallel in an assembled carton. However, fold lines 23 and 53 are substantially orthogonal to, or at least partially at an angle to, fold line 43 in a partially assembled, collapsed carton.

Figure 6:
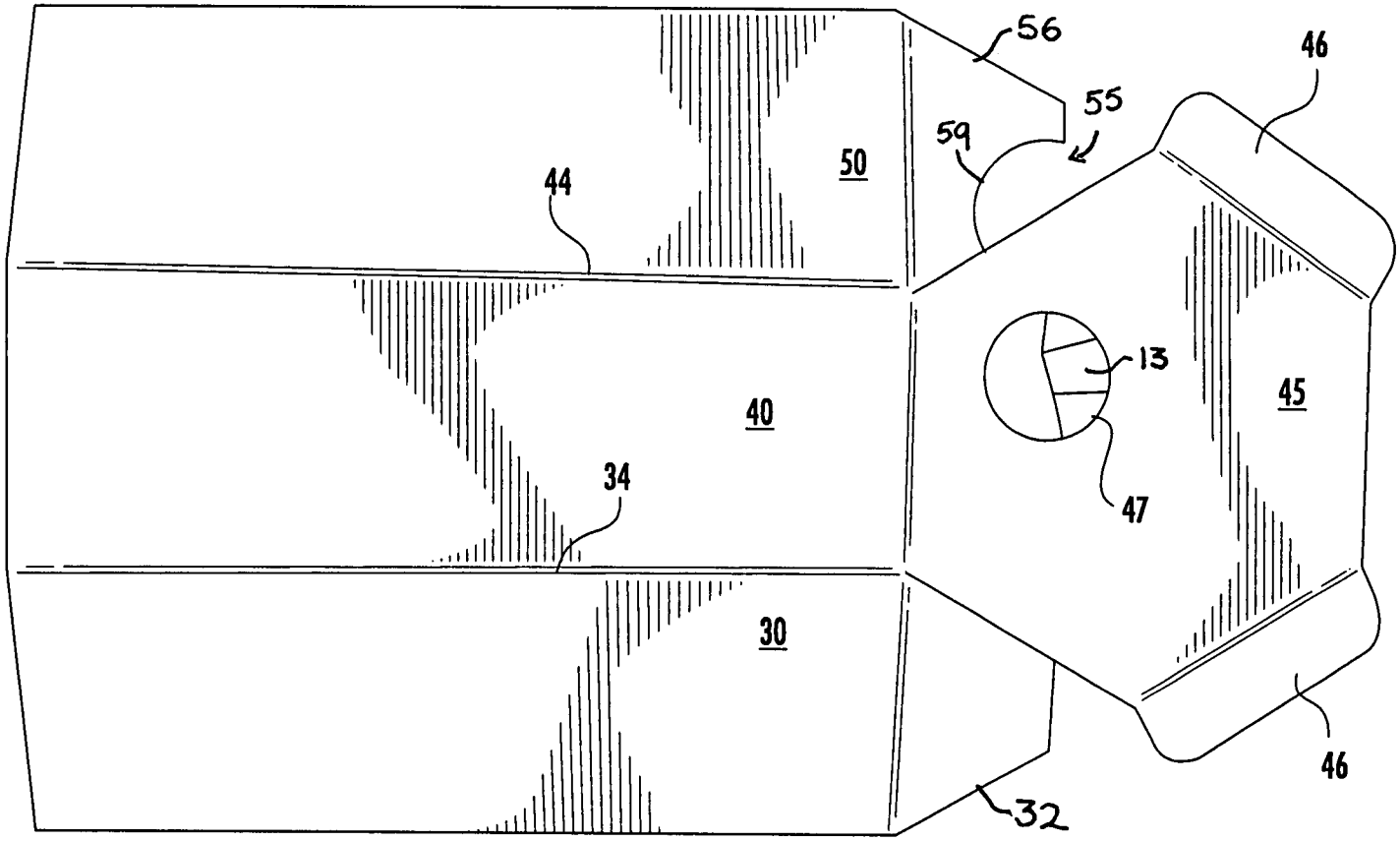
FIG. 6 illustrates one side of a partially formed carton.
Figure 7:
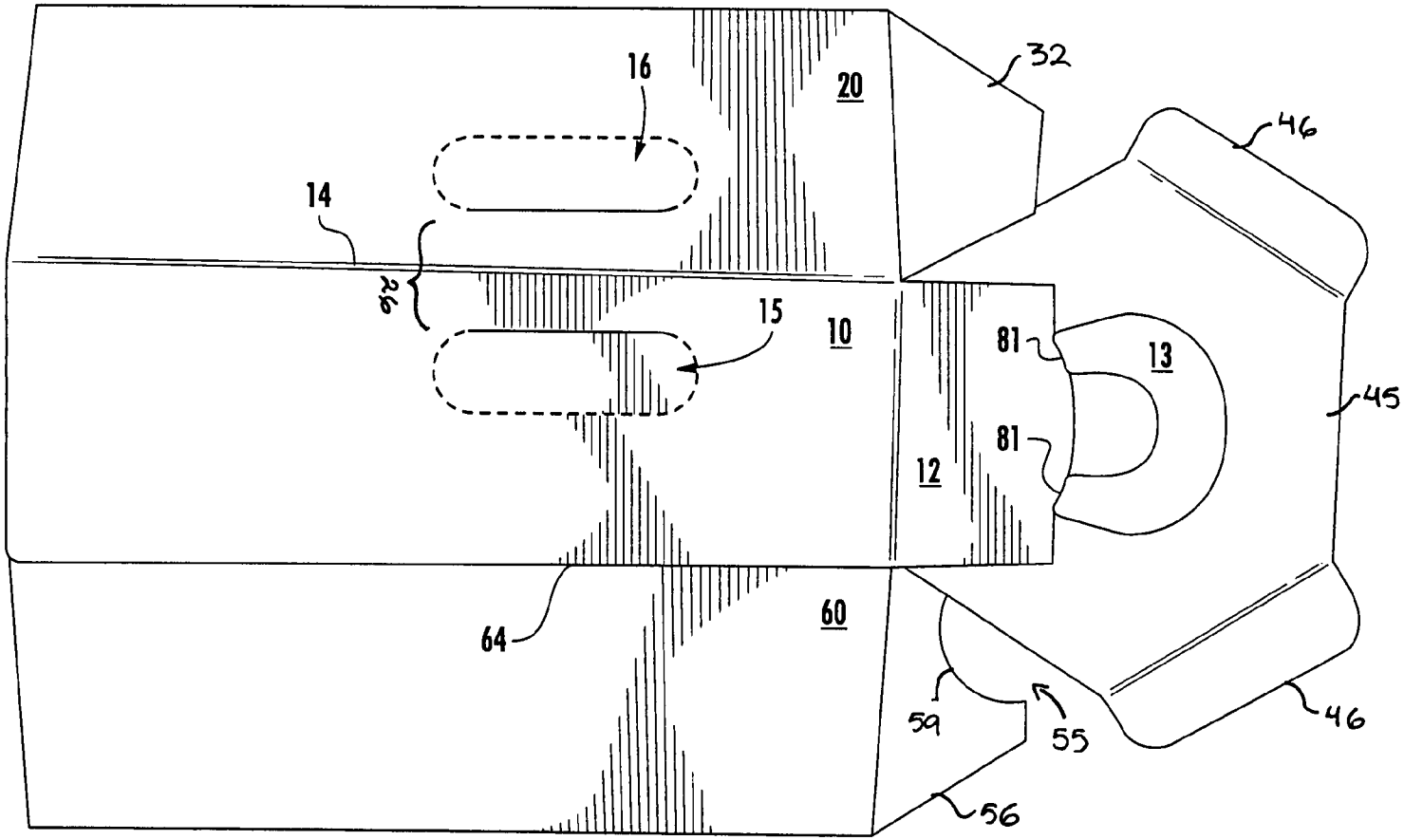
FIG. 7 illustrates another side of a partially formed carton.

On embodiment of a method of assembling the carton 5 from the blank 3 will be described herein. The method of assembling or forming the carton 5 could include other steps than those illustrated and described herein without departing from the disclosure. FIGS. 6 and 7 illustrate a partially formed collapsed carton. To form carton 5 from blank 3, side panels 10, 20, and 30 are positioned to form at least three sides of the hexagonal form of the top panel 45, and side panels 40, 50, and 60 are positioned to form an additional three sides of the hexagonal form of the top panel 45, so that a generally hexagonal-shaped interior space 77 is formed. Attachment flap 62 is adhered to an interior portion of side panel 10, second panel portion 22 is adhered in at least partial face-to-face contact with bottom flap 31, second panel portion 52 is adhered in at least partial face-to-face contact with bottom flap 61, and second panel portion 42 is adhered in at least partial face-to-face contact with bottom flap 11. Thereafter, the partially assembled carton is collapsed by inflecting the adhered compound bottom flaps 28, 48, and 58 for flat-packaging, transport, and storage of the collapsed cartons.

Figure 8:
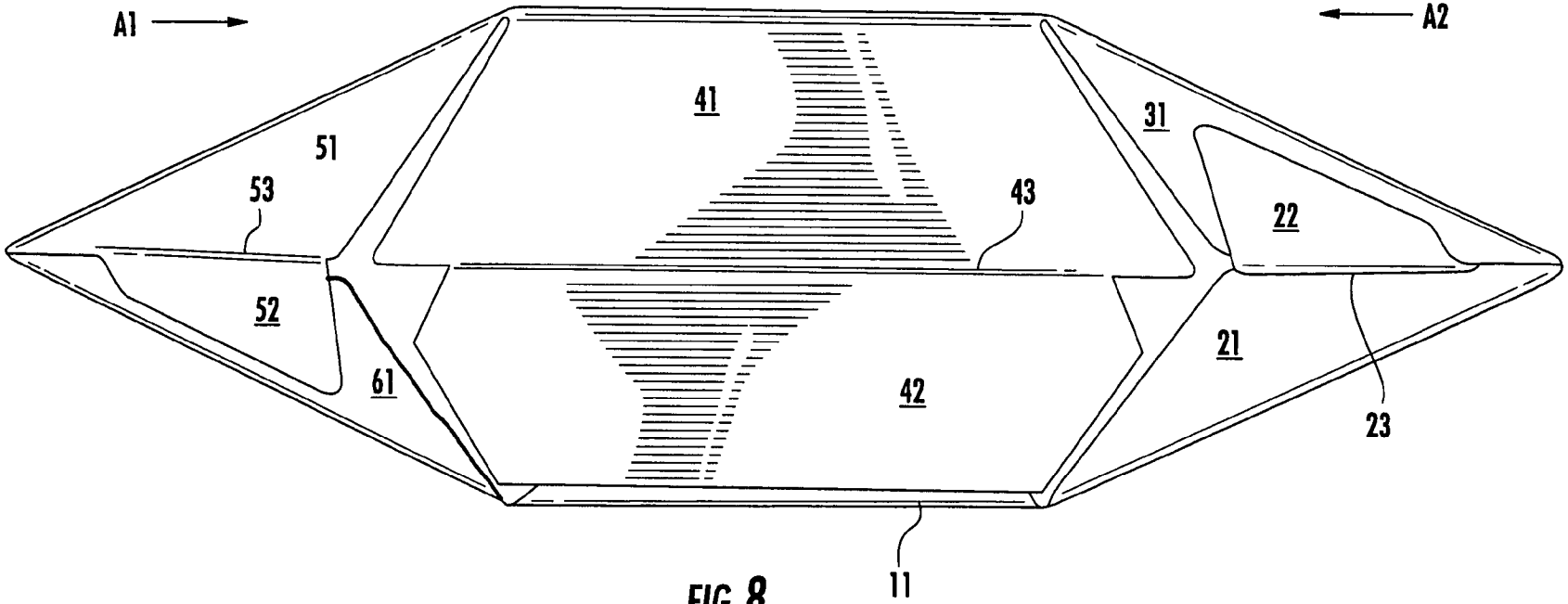
FIG. 8 is a bottom view of a partially formed carton.
Figure 9:
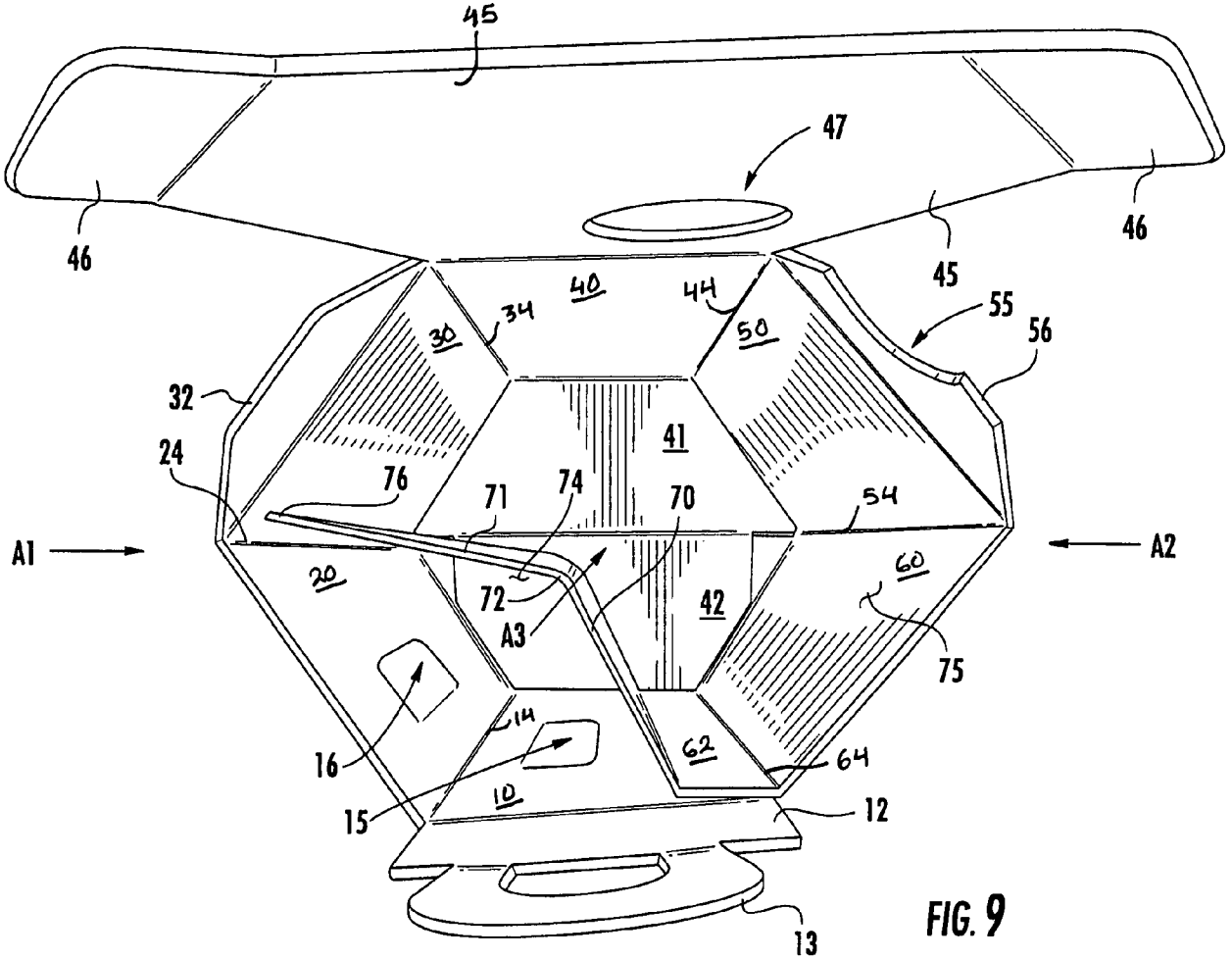
FIG. 9 is a top view of a partially formed carton.

As shown in FIGS. 8 and 9, the carton 5 is formed by applying lateral force along directions A1 and A2 such that compound bottom panels 28, 48, and 58 act to form a plane and substantially planar bottom panel of the carton 5, while the feature 7 and free edge 76 engage fold line 24. Free edge 76 may be adjacent to fold line 24 in some embodiments, or may be in contact with either of side panels 20, 30 in other embodiments. Furthermore, feature 7 deflects in direction A3 while pivoting on fold line 72 during application of force. As such, free edge 76 of the panel 71 engages an interior aspect of fold line 24 (or either of panels 10, 20) and provides at least partial support thereto.

Figure 11:
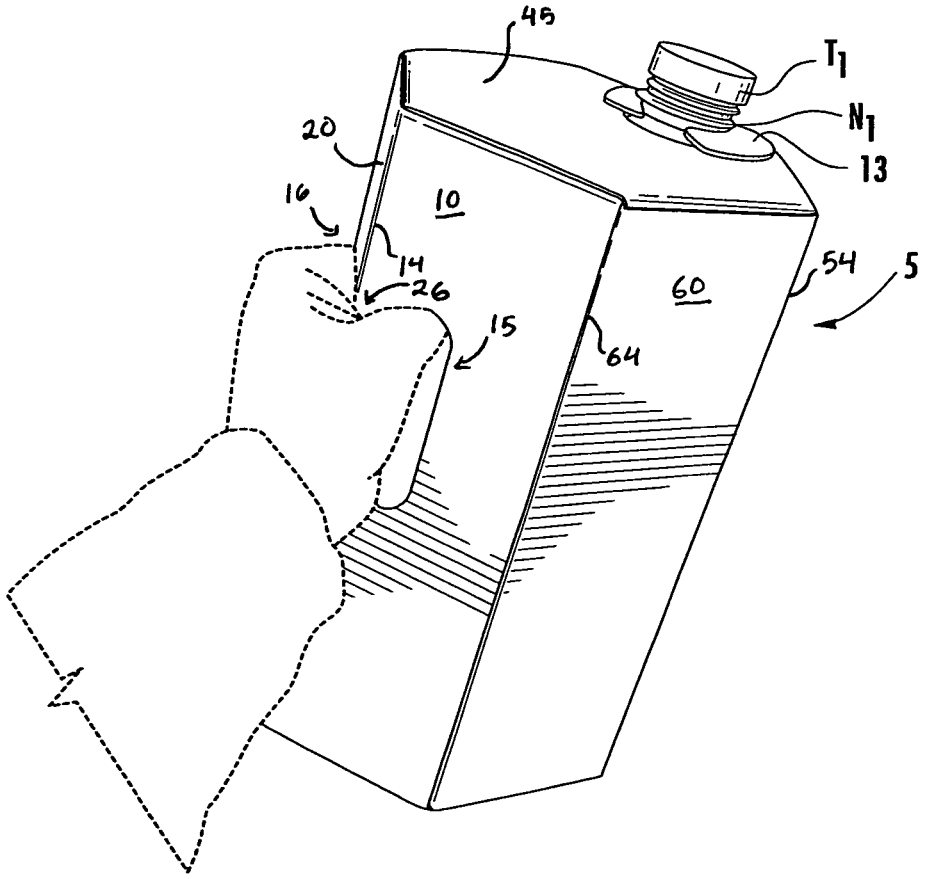
FIG. 11 is a perspective view of a carton with an article contained therein.

As illustrated in FIGS. 10 and 11, in the assembled carton 5, the panels 71, 72 divide the interior 77 into a first portion 75 and a second portion 74, each separated by a protective handle feature 7 formed of panels 70 and 71. The carton interior 77 comprising both the interior portions or cavities 74, 75 is generally hexagonal-shaped. The second interior cavity 74 may be configured to receive a user's hand or a portion thereof as inserted through handle openings in at least one panel of the carton 5. The second interior cavity 74 may be termed an access portion of the interior of the carton 5. The first interior cavity 75 may be configured to receive and support container $C_1$. As illustrated, the panels 70 and 71 may be non-coplanar with the side panels 10, 20 in the erected carton 5 with the panel 70 extending from side panel 10 at a first angle and the panel 71 extending from a side panel 20 or 30 at a second angle. The panels 70 and 71 may be sized and dimensioned to protect a user's hand or portion thereof inserted into the second interior cavity 74 from contact with an exterior surface of the container $C_1$ (e.g., protection from hot or cold liquids contained therein, etc). Similarly, the panels 70 and 71 may be sized and dimensioned to protect an exterior surface of the container $C_1$ from a user's hand or portion thereof (e.g., fingernails, jewelry, etc). Therefore, the protective handle features described herein provide protection to and from a user's hand or portion thereof used in carrying the carton 5. Furthermore, a neck portion $N_1$ of the top $T_1$ of container $C_1$ may protrude through the opening 47 and be retained by collar 13. In this manner, a user may access the contents of the container $C_1$ without depressing the top $T_1$ into the interior cavity 75 away from reach. Furthermore, the cutout 55 (positioned in the interior of the carton 5) is configured to allow the top $T_1$ of container $C_1$ relatively unhindered access to the cutout 47.

Figure 12:
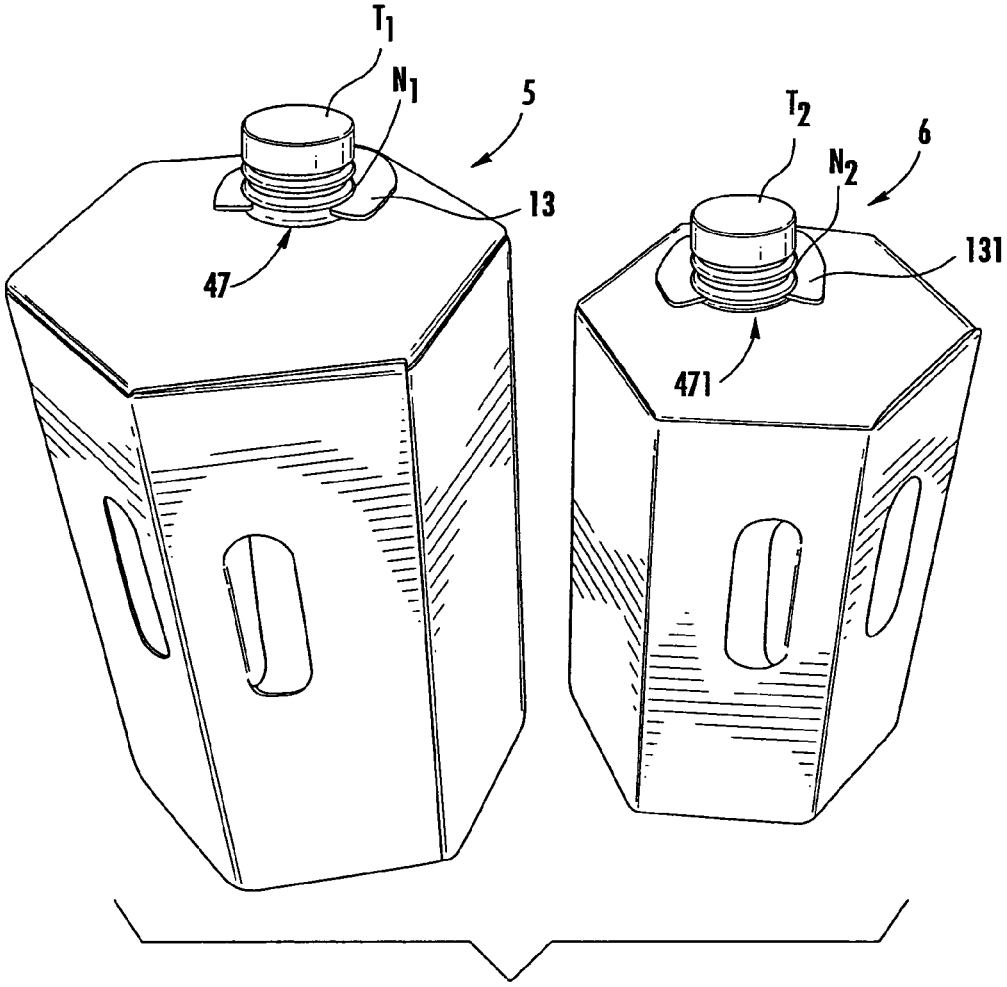
FIG. 12 is a perspective view of multiple embodiments of assembled cartons with articles contained therein.

FIG. 12 is a perspective view of multiple embodiments of assembled cartons 5, 6 populated with containers. As shown, each embodiment includes a collar 13, 131 configured to retain a neck portion $N_1$, $N_2$ of respective tops $T_1$, $T_2$ and to prevent the same from falling into an interior of a carton through openings 47, 471.

In general, the blank 3 may be constructed from cardboard having a caliper so that it is heavier and more rigid than ordinary paper. The blank can also be constructed of other materials, such as paperboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing at least one article, the carton comprising:

a plurality of side panels that extend at least partially around an interior of the carton, the plurality of side panels comprising an interior surface;

a handle for grasping and carrying the carton formed in at least two side panels of the plurality of side panels; and a protective feature for providing access to grasp the handle, the protective feature comprising at least a first protective panel and a second protective panel foldably connected to the first protective panel, the first protective panel and the second protective panel being arranged in the interior of the carton relative to the handle and the at least two side panels, the second protective panel comprising a free distal edge, and the free distal edge being in contact with the interior surface.

2. The carton of claim 1, wherein the handle comprises at least two handle openings in the at least two side panels.

3. The carton of claim 2, wherein the handle comprises a handle portion between the handle openings, the handle portion comprising a portion of the at least two side panels.

4. The carton of claim 2, wherein the first protective panel and the second protective panel are arranged relative to the at least two handle openings to divide a portion of the interior of the carton into a first portion for receiving the at least one article and a second portion providing access for grasping the handle.

5. The carton of claim 4, wherein the protective feature extends from one panel of the plurality of side panels to another panel of the plurality of side panels to divide the interior of the carton.

6. The carton of claim 4, wherein the plurality of side panels comprises a first side panel, a second side panel foldably connected to the first side panel, a third side panel foldably connected to the second side panel, a fourth side panel foldably connected to the third side panel, a fifth side panel foldably connected to the fourth side panel, and a sixth side panel foldably connected to the fifth side panel, the carton further comprising an attachment flap foldably connected to the sixth side panel and having a free edge.

7. The carton of claim 6, wherein the attachment flap is adhered to one of the first side panel and the second side panel.

8. The carton of claim 1, wherein the carton further comprises an attachment flap foldably connected to a panel of the plurality of side panels, and wherein the first protective panel is foldably connected to the attachment flap.

9. The carton of claim 1, wherein the second protective panel is foldably connected to the first protective panel at a fold line.

10. The carton of claim 9, wherein the second protective panel is positionable at the fold line relative to the first protective panel to form the protective feature.

11. The carton of claim 1, wherein the at least two side panels comprises a first side panel and a second side panel, the plurality of side panels comprises a third side panel, the third side panel is foldably connected to the second side panel at a fold line, and the free distal edge is adjacent the fold line.

12. The carton of claim 11, wherein the free distal edge is in contact with at least one of the second side panel and the third side panel.

13. The carton of claim 1, wherein the plurality of side panels comprises at least six side panels forming a hexagonal-shaped interior, and wherein the first protective panel and the second protective panel are arranged to extend at least partially across a vertex of the hexagonal-shaped interior.

14. The carton of claim 1, wherein the carton further comprises a top panel foldably connected to at least one side panel of the plurality of side panels, the top panel comprising an access opening for at least partially receiving a portion of the at least one article.

15. The carton of claim 1, further comprising a plurality of end flaps foldably connected to respective side panels of the plurality of side panels, the plurality of end flaps are for forming a bottom panel of the carton.

16. The carton of claim 15, wherein one end flap of the plurality of end flaps comprises a first bottom panel portion foldably connected to one side panel of the plurality of side panels and a second bottom panel portion foldably connected to the first bottom panel portion at an oblique fold line, wherein the first bottom panel portion is configured to pivot relative to the second bottom panel portion to form a substantially planar bottom panel of the carton.

17. The carton of claim 16, further comprising a notch positioned adjacent to the oblique fold line for facilitating the pivoting of the first bottom panel portion.

18. The carton of claim 16, wherein the one end flap is a first end flap and the plurality of end flaps comprises a second end flap that comprises a third bottom panel portion foldably connected to one side panel of the plurality of side panels and a fourth bottom panel portion foldably connected to the third bottom panel portion at a second oblique fold line, wherein the third bottom panel portion is configured to pivot relative to the fourth bottom panel portion to form the substantially planar bottom panel of the carton.

19. The carton of claim 18, wherein the plurality of end flaps comprises a third end flap that comprises a fifth bottom panel portion foldably connected to one side panel of the plurality of side panels and a sixth bottom panel portion foldably connected to the fifth bottom panel portion at a longitudinal fold line, wherein the fifth bottom panel portion is configured to pivot relative to the sixth bottom panel portion and be at least partially in face-to-face contact with the first, second, third, and fourth bottom panel portions.

20. The carton of claim 1, wherein the protective feature divides at least a portion of the interior of the carton into a first portion for receiving the at least one article and a second portion providing access for grasping the handle, the second portion being defined by at least the at least two side panels, the first protective panel, and the second protective panel and comprising an interior corner that is spaced apart from the interior surface.

21. A blank for forming a carton for containing at least one article, the blank comprising:

a plurality of side panels for forming an interior of the carton formed from the blank, the plurality of side panels comprising an interior surface;

handle features in at least two side panels of the plurality of side panels for forming a handle for grasping and carrying the carton formed from the blank; and a protective feature for providing access to grasp the handle, the protective feature comprising at least a first protective panel and a second protective panel foldably connected to the first protective panel, the first protective panel and the second protective panel being configured to be arranged in the interior relative to the handle and the at least two side panels in the carton formed from the blank, the second protective panel comprising a free distal edge, and the free distal edge being in contact with the interior surface when the carton is formed from the blank.

22. The blank of claim 21, wherein the handle features comprise at least two handle openings in the at least two side panels.

23. The blank of claim 22, wherein the handle features comprise a handle portion between the handle openings, the handle portion comprising a portion of the at least two side panels.

24. The blank of claim 22, wherein the first protective panel and the second protective panel are configured to divide a portion of the interior of the carton formed from the blank into a first portion for receiving the at least one article and a second portion providing access for grasping the handle.

25. The blank of claim 24, wherein the plurality of side panels comprises a first side panel, a second side panel foldably connected to the first side panel, a third side panel foldably connected to the second side panel, a fourth side panel foldably connected to the third side panel, a fifth side panel foldably connected to the fourth side panel, and a sixth side panel foldably connected to the fifth side panel, the blank further comprising an attachment flap foldably connected to the sixth side panel and having a free edge.

26. The blank of claim 25, wherein the first protective panel is foldably connected to the attachment flap.

27. The blank of claim 21, wherein the blank further comprises an attachment flap foldably connected to a panel of the plurality of side panels, and wherein the first protective panel is foldably connected to the attachment flap.

28. The blank of claim 25, wherein the attachment flap is for being adhered to one of the first side panel and the second side panel in the carton formed from the blank.

29. The blank of claim 21, wherein the the second protective panel is foldably connected to the first protective panel at a fold line.

30. The blank of claim 29, wherein the second protective panel is positionable at the fold line relative to the first protective panel to form the protective feature in the carton formed from the blank.

31. The blank of claim 21, further comprising a top panel foldably connected to at least one side panel of the plurality of side panels, the top panel comprising an access opening for at least partially receiving a portion of the at least one article in the carton formed from the blank.

32. The blank of claim 21, further comprising a plurality of end flaps foldably connected to respective side panels of the plurality of side panels, the plurality of end flaps are for forming a bottom panel of the carton formed from the blank.

33. The blank of claim 32, wherein one end flap of the plurality of end flaps comprises a first bottom panel portion foldably connected to one side panel of the plurality of side panels and a second bottom panel portion foldably connected to the first bottom panel portion at an oblique fold line, wherein the first bottom panel portion is configured to pivot relative to the second bottom panel portion to form a substantially planar bottom panel of the carton formed from the blank.

34. The blank of claim 33, further comprising a notch positioned adjacent to the oblique fold line for facilitating the pivoting of the first bottom panel portion.

35. The blank of claim 33, wherein the one end flap is a first end flap and the plurality of end flaps comprises a second end flap that comprises a third bottom panel portion foldably connected to one side panel of the plurality of side panels and a fourth bottom panel portion foldably connected to the third bottom panel portion at a second oblique fold line, wherein the third bottom panel portion is configured to pivot relative to the fourth bottom panel portion to form the substantially planar bottom panel of the carton formed from the blank.

36. The blank of claim 35, wherein the plurality of end flaps comprises a third end flap that comprises a fifth bottom panel portion foldably connected to one side panel of the plurality of side panels and a sixth bottom panel portion foldably connected to the fifth bottom panel portion at a longitudinal fold line, wherein the fifth bottom panel portion is configured to pivot relative to the sixth bottom panel portion and be at least partially in face-to-face contact with the first, second, third, and fourth bottom panel portions in the carton formed from the blank.

37. The blank of claim 21, wherein the protective feature divides at least a portion of the interior of the carton formed from the blank into a first portion for receiving the at least one article and a second portion providing access for grasping the handle, the second portion being defined by at least the at least two side panels, the first protective panel, and the second protective panel and comprising an interior corner that is spaced apart from the interior surface.

38. A method of forming a carton for containing at least one article, comprising:

obtaining a blank comprising a plurality of side panels, handle features in at least two side panels of the plurality of side panels for forming a handle, and a protective feature for providing access to grasp the handle, the protective feature comprising at least a first protective panel and a second protective panel foldably connected to the first protective panel, the second protective panel comprising a free distal edge;

folding the plurality of side panels to at least partially form an interior of the carton and an interior surface;

positioning the first protective panel and the second protective panel in the interior relative to the handle and the at least two side panels; and positioning the free distal edge to be in contact with the interior surface.

39. The method of claim 38, wherein the features for forming the handle comprise at least two handle openings in the at least two side panels and a handle portion between the handle openings, the handle portion comprising a portion of the at least two side panels, the method comprising positioning the first protective panel and the second protective panel relative to the at least two handle openings to divide a portion of the interior of the carton into a first portion for receiving the at least one article and a second portion providing access for grasping the handle.

40. The method of claim 38, wherein the protective feature extends from one panel of the plurality of side panels to another panel of the plurality of side panels to divide the interior of the carton.

41. The method of claim 38, wherein the plurality of side panels comprises a first side panel, a second side panel foldably connected to the first side panel, a third side panel foldably connected to the second side panel, a fourth side panel foldably connected to the third side panel, a fifth side panel foldably connected to the fourth side panel, and a sixth side panel foldably connected to the fifth side panel, the blank further comprising an attachment flap foldably connected to the sixth side panel and having a free edge, the method comprises attaching the attachment flap to the first side panel to form the interior.

42. The method of claim 38, wherein the second protective panel is foldably connected to the first protective panel at a fold line, and the method comprises positioning the first protective panel relative to one of the plurality of side panels at a first angle and positioning the second protective panel relative to one of the plurality of side panels at a second angle.

43. The method of claim 38, wherein the blank further comprises a plurality of end flaps foldably connected to respective side of the plurality of side panels, the method comprising folding the plurality of end flaps to form a bottom panel.

44. The method of claim 38, further comprising positioning the first protective panel and the second protective panel to divide the interior into a first portion and a second portion.

45. The method of claim 44, further comprising inserting the at least one article in the first portion of the interior.

46. The method of claim 45, further comprising grasping the handle and accessing the second portion of the interior through the handle features.

47. The method of claim 38, further comprising positioning the protective feature to divides at least a portion of the interior of the carton into a first portion for receiving the at least one article and a second portion providing access for grasping the handle, the positioning the protective feature comprising positioning at least the at least two side panels, the first protective panel, and the second protective panel to define the second portion and to define an interior corner that is spaced apart from the interior surface.

* * * * *